US008113855B2

(12) United States Patent
Green et al.

(10) Patent No.: US 8,113,855 B2
(45) Date of Patent: Feb. 14, 2012

(54) ELECTRICAL POWER ADAPTER

(75) Inventors: Chris Green, San Francisco, CA (US); John E. Johnston, Redwood City, CA (US); Lawrence E. Davis, Atlanta, GA (US); Daniel R. Bauen, Atlanta, GA (US)

(73) Assignee: Amazon Technologies, Inc., Reno, NV (US)

( * ) Notice: Subject to any disclaimer, the term of this patent is extended or adjusted under 35 U.S.C. 154(b) by 119 days.

(21) Appl. No.: 12/360,095

(22) Filed: Jan. 26, 2009

(65) Prior Publication Data

US 2010/0190363 A1 Jul. 29, 2010

(51) Int. Cl.
*H01R 13/44* (2006.01)

(52) U.S. Cl. ..... 439/131; 439/172

(58) Field of Classification Search ..... 439/131, 439/104, 103, 172
See application file for complete search history.

(56) References Cited

U.S. PATENT DOCUMENTS

| | | | | |
|---|---|---|---|---|
| D105,216 | S | 7/1937 | Herman | |
| D258,429 | S | 3/1981 | Buckler | |
| 4,543,624 | A | 9/1985 | Rumble | |
| D305,326 | S | 1/1990 | Clayton, Jr. | |
| D338,188 | S | 8/1993 | Lee et al. | |
| D350,113 | S | 8/1994 | Nagele | |
| D367,257 | S | 2/1996 | Buelow et al. | |
| 5,648,712 | A | 7/1997 | Hahn | |
| D383,115 | S | 9/1997 | Nagele et al. | |
| 5,684,689 | A | 11/1997 | Hahn | |
| 5,744,934 | A | 4/1998 | Wu | |
| D400,174 | S | 10/1998 | Shatkin | |
| D406,259 | S | 3/1999 | Lindahl | |
| 5,973,948 | A | 10/1999 | Hahn et al. | |
| D416,226 | S | 11/1999 | Lohrding et al. | |
| 6,086,395 | A | 7/2000 | Lloyd et al. | |
| D432,497 | S | 10/2000 | Totsuka et al. | |
| D434,378 | S | 11/2000 | Ullmann | |
| D446,499 | S | 8/2001 | Andre et al. | |
| D449,030 | S | 10/2001 | Baxter et al. | |
| D452,842 | S | 1/2002 | Kajiwara et al. | |
| D456,008 | S | 4/2002 | Kawanobe et al. | |
| D463,366 | S | 9/2002 | MacKay | |
| D474,739 | S | 5/2003 | Chang | |
| D484,853 | S | 1/2004 | Alviar | |
| 6,845,023 | B2 | 1/2005 | Philips et al. | |
| D503,679 | S | 4/2005 | Andre et al. | |
| 7,425,132 | B2 * | 9/2008 | Yang et al. | 439/4 |
| D583,316 | S | 12/2008 | Sade et al. | |
| D601,500 | S | 10/2009 | Green et al. | |
| 7,597,570 | B2 * | 10/2009 | So | 439/172 |
| 7,632,119 | B1 * | 12/2009 | Ma et al. | 439/172 |
| 7,658,625 | B2 * | 2/2010 | Jubelirer et al. | 439/131 |
| 2003/0068909 | A1 * | 4/2003 | Su | 439/131 |
| 2008/0076279 | A1 * | 3/2008 | Wu et al. | 439/131 |
| 2009/0191735 | A1 * | 7/2009 | Lin | 439/131 |

* cited by examiner

*Primary Examiner* — Hien Vu
(74) *Attorney, Agent, or Firm* — Lee & Hayes, PLLC

(57) ABSTRACT

Electrical power adapters comprising retractable prongs and/or retractable electrical outputs are disclosed. In one example, an electrical travel adapter includes a power unit having a retractable electrical output and a plug unit coupled to the power unit, the plug unit having a plurality of retractable prongs.

4 Claims, 5 Drawing Sheets

ELECTRICAL POWER ADAPTER

BACKGROUND

Portable electronic devices, such as gaming devices, mobile telephones, portable televisions, electronic book reader devices, and the like, are becoming increasingly popular. These devices typically are powered by batteries. Many devices also include an alternating current (AC) power adapter that allow the devices to run on AC current from a receptacle, and may also be used to recharge the batteries of the device. Typically, AC adapters are designed for use with a particular type of receptacle standard (e.g., prong configuration, power rating, and frequency). Some existing AC travel adapters include provisions that allow the adapters to be used with multiple different electrical plug standards.

Users often store or transport portable electronic devices along with their AC adapters in a carrying case or backpack, for example. Because most AC adapters have prongs that protrude from the adapter to be plugged into an outlet, the prongs are often bent or damaged during transport. The protruding prongs may also cause damage to a screen or housing of the portable electronic device.

Users often unplug AC adapters by pulling on a cord of the AC adapter adjacent to a plug. However, unplugging an AC adapter by pulling on the cord adjacent to the plug has the potential to damage the cord, possibly resulting in a fault, short, or even electrical shock to the user.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items.

DETAILED DESCRIPTION

Overview

As discussed above, when transported with portable electronic devices, the prongs of existing AC adapters have the potential to be damaged by, and/or to cause damage to, the portable electronic device during transport. Also, existing AC adapters are prone to damage by users unplugging them by pulling on their cords.

This disclosure describes examples of electrical power adapters that include retractable prongs that can be retracted during non-use to protect the prongs from being damaged or causing damage to the electronic device or other equipment. This disclosure also describes examples of electrical power adapters that additionally or alternatively include retractable power outputs that can be retracted during use to prevent users from pulling on a cord adjacent to the adapter to remove the adapter from a receptacle.

The electrical power adapters are described in the context of AC travel adapters usable to provide power to a portable electronic device from a variety of different electrical outlet standards. However, aspects of this disclosure may be applicable to other sorts of electrical power adapters, such as direct current (DC) power adapters or the like. Also, aspects of this disclosure, such as the retractable prongs, for example, may be applicable to electrical power adapters other than travel adapters. Still further, aspects of this disclosure may be applicable to provide power to electronic devices other than portable electronic devices.

Example Electrical Power Adapter

Figure 1:
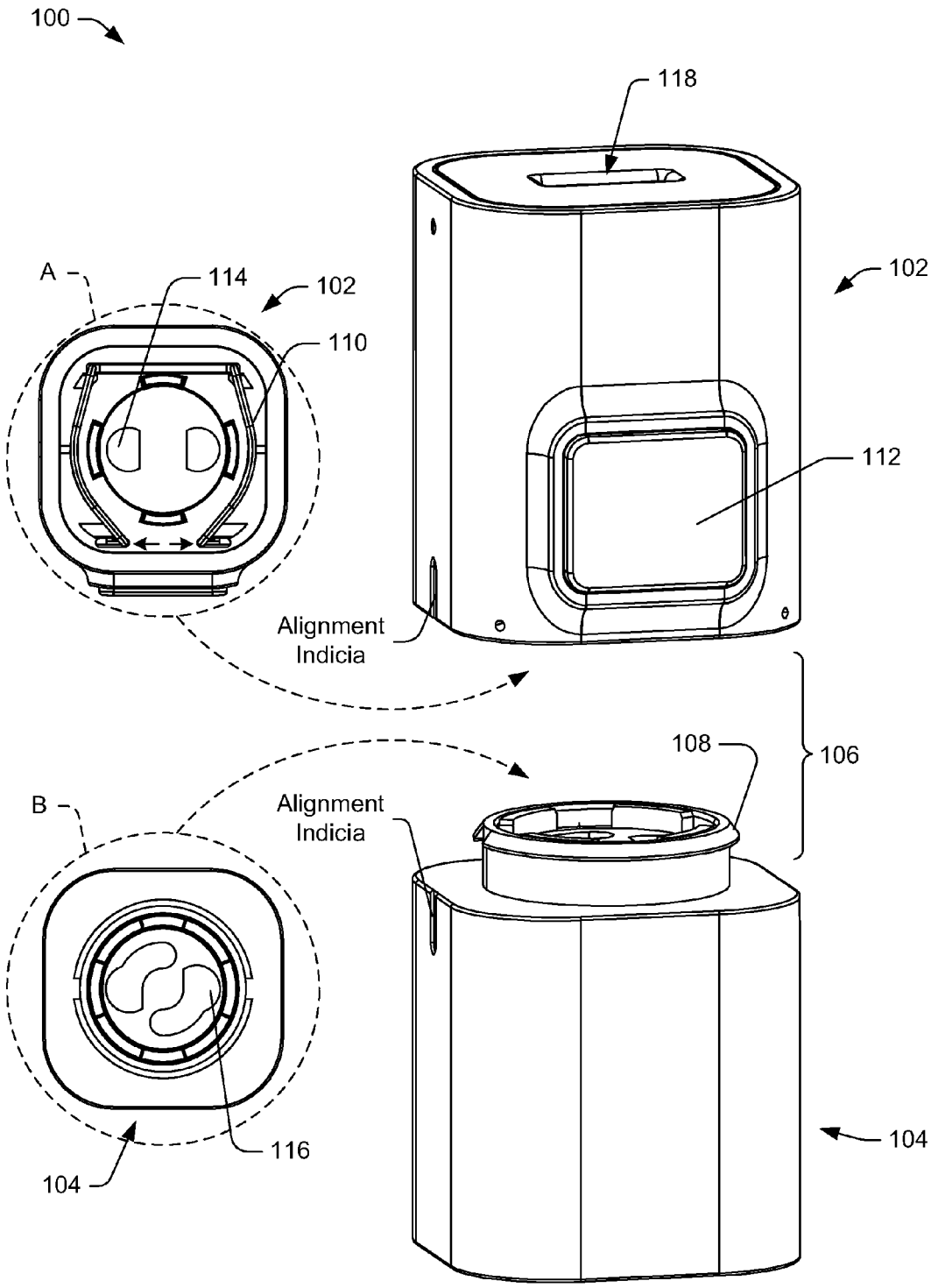
FIG. 1 is a schematic diagram of an illustrative power adapter having a two-piece construction in an unassembled condition.

FIG. 1 illustrates an electrical power adapter 100 according to one illustrative embodiment in a non-use position. The electrical power adapter 100 shown in FIG. 1 is a travel adapter that is usable substantially worldwide. Generally, the electrical power adapter 100 includes a power unit 102 and one or more interchangeable electrical plug units 104 (only one is shown in FIG. 1). Each of the electrical plug units 104 may be configured to work with a different international plug standard. Thus, by changing the plug unit 104, electrical power adapter 100 may be used with any of the different international plug standards. Electrical plug units 104 may comprise plugs of, for example, Type A (North American/Japanese 2-pin), Type B (American 3-pin or U-ground), Type C (European 2-pin), Type D (Old British 3-pin), Type E (French 2-pin, female earth), Type F (German 2-pin, side clip earth), Type E and F hybrid, Type G (British 3-pin), Type H (Israeli 3-pin), Type I (Australian/New Zealand & Chinese/Argentinian 2/3-pin), Type J (Swiss 3-pin), Type K (Danish 3-pin), Type L (Italian 3-pin), and/or any other plug standard. In some implementations, the plug units 104 may include indicia specifying a plug standard in which the prongs are configured. For example, different plug standards may be designated by a textual label, a color, a symbol, etc. In one specific example, the plug standard may be identified by a flag (or portion thereof) of a country employing the standard.

The plug units 104 can be removably coupled to the power unit 102 via a suitable connection means 106. Details of the connection means 106 are shown in the detail views A and B to the side of FIG. 1. Detail view A is a bottom view of the power unit 102 and detail view B is a top view of the plug unit 104. In the implementation shown, the connection means 106 comprises a spring-loaded connection. As the plug unit 104 is pressed into engagement with the power unit 102, a tapered collar 108 of the plug unit 104 engages with a spring latch 110 of the power unit 102. The tapered shape of the collar 108 expands the spring latch 110 in the direction of the arrows shown in detail view A. Once a trailing edge of the tapered collar 108 clears the spring latch 110, the spring latch contracts to retain the collar 108, thereby securing the plug unit 104 to the power unit 102.

A release button 112 is provided on the power unit 102 to selectively release the spring latch 110 when depressed by a user. This provides a secure connection between the power unit 102 and the respective plug units 104, which can be quickly and easily be detached by actuation of the release button 112. However, in other implementations, other types of removable connection means, such as snap fits, latch mechanisms, threaded fits, slots, grooves, or the like may be used to couple the plug units 104 to the power unit 102. Referring back to the illustrated implementation, the mating components of the connection means 106 (i.e., the collar 108 and spring latch 110) may be reversed, such that the collar 108 is disposed on the power unit 102 and the spring latch 110 is disposed on the plug unit 104. Moreover, other types of release mechanisms (e.g., levers, slides, knobs, dials, etc.) may be used to disengage the plug units 104 from the power unit 102.

The power unit 102 includes electrical terminals 114 that engage with corresponding electrical terminals 116 on the plug units. When a plug unit 104 is coupled to the power unit 102 by the spring latch 110 (or other connection means), the electrical terminals 114 of the power unit 102 are firmly pressed against the electrical terminals 116 of the plug unit to provide a reliable electrical connection. In some implementations, when the plug unit 104 is coupled to the power unit 102, the electrical terminals 114 and 116 may be spring biased toward one another to provide an even more secure connection. In that case, the spring force between the electrical terminals 114 and 116 may also cause the plug unit 104 to be ejected from the power unit 102 when the release button 112 is depressed, rather than simply being released.

Alignment indicia may also be provided on the power unit 102 and/or the plug units 104 to aid a user in aligning the two units for connection. The alignment indicia may include linear indicia (as shown), dots, shapes, colors, words, or any other indicia that aid a user in aligning the two parts relative to one another. The alignment indicia may be recessed (as shown) or raised to provide tactile feedback to a user, or may be flush with the surfaces of the power unit 102 and plug units 104.

The power unit 102 also includes an electrical output 118 for outputting electrical power to power an electronic device (not shown). In the illustrated example, the electrical output 118 comprises a universal serial bus (USB) port. However, in other implementations, other types of electrical outputs could additionally or alternatively be used.

Figure 2:
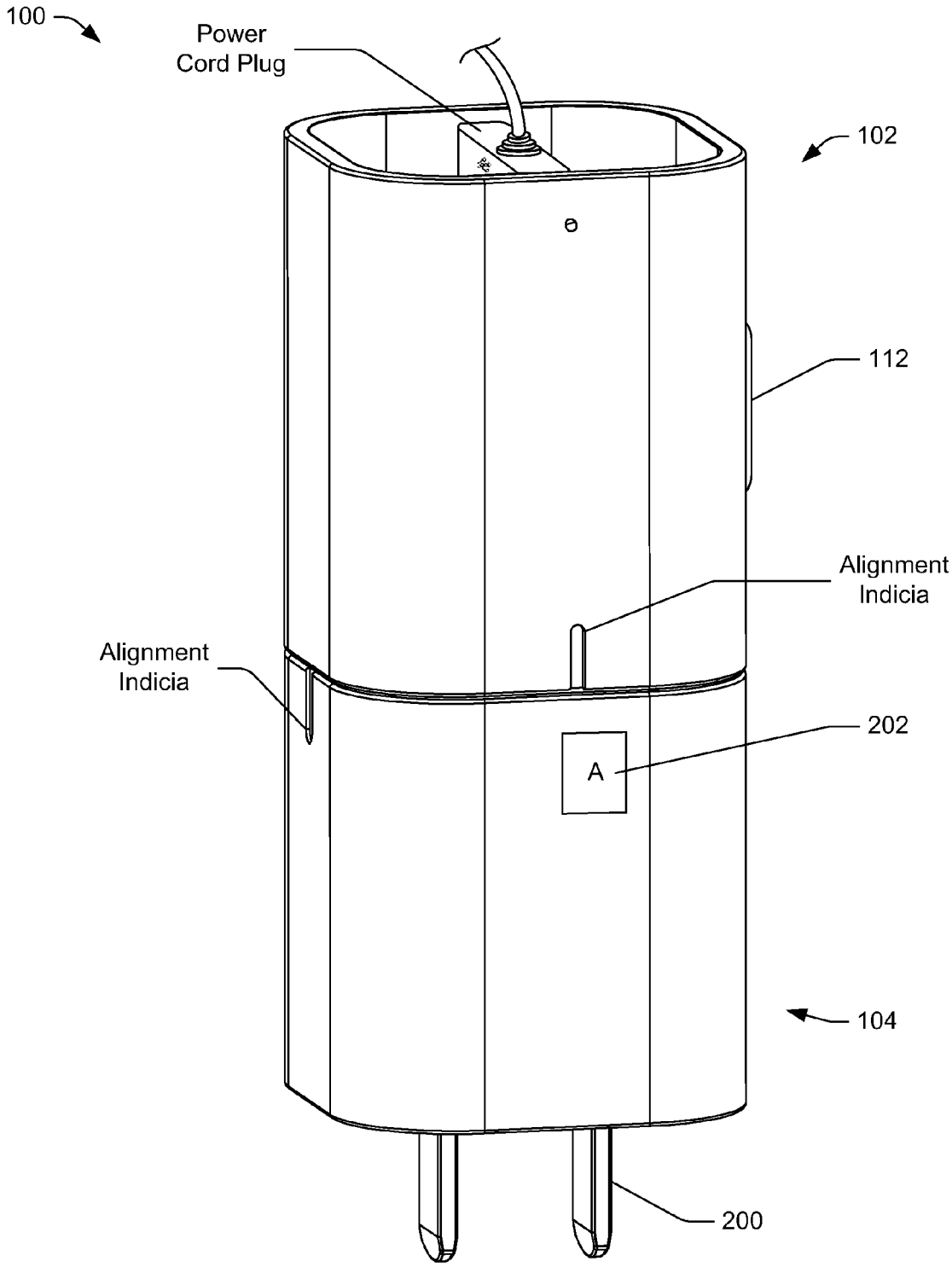
FIG. 2 is a schematic diagram of the power adapter of FIG. 1 assembled and in a use condition.

FIG. 2 shows the electrical power adapter 100 in a use position. As shown in FIG. 2, in the use position, prongs 200 protrude from the bottom of the plug unit 104 to plug into a receptacle. The plug units 104 each include prongs configured according to one of the foregoing plug standards to plug into a receptacle having the same plug standard as the respective plug unit 104. For example, the plug unit 104 shown in FIG. 2 has prongs configured according to the Type A (North American/Japanese 2-pin) standard. Also, in the use position shown in FIG. 2, the electrical output 118 is retracted within a housing of the power unit 102 to prevent a cord plugged into the electrical outlet from being inadvertently removed by pulling on the cord adjacent to the plug. FIG. 2 illustrates the Type A standard as a textual label 202, however, and as discussed above, different plug standards may be designated by a color, a symbol, a flag (or portion thereof) of a country employing the standard, etc.

Retractable Prongs

As discussed above, users often store or transport portable electronic devices along with their AC adapters in a carrying case or backpack, for example. AC adapters having prongs that protrude from the adapter may be bent or damaged during transport and/or the protruding prongs may also cause damage to the portable electronic device. Some existing AC adapters have prongs that fold away during storage. However, if the prongs fold too easily, they tend to fold up unintentionally when a user tries to plug the adapter into an outlet. If, on the other hand, the prongs do not fold easily, it can be difficult to fold the prongs out for use.

This disclosure describes AC adapters that have prongs 200 that can be retracted during storage or non-use (as shown in FIG. 1) and can easily and firmly be extended during use (as shown in FIG. 2) by simply rotating the plug unit 104 relative to the power unit 102. In this example, extension of the prongs is accomplished by rotating the plug unit 104 about 90 degrees relative to the power unit 102, as shown by the alignment indicia in FIG. 2. However, in other examples, the angle of rotation from the non-use position to the use position may be greater or less than 90 degrees (e.g., 30 degrees, 45 degrees, 180 degrees, or the like). In contrast to AC adapters with folding prongs which often require users to manipulate small parts, the objects being rotated by the user in this example (i.e., the plug unit 104 and power unit 102) are relatively large and easy to grasp and manipulate by a user. Also, because the prongs 200 are extended by rotating the plug unit 104 relative to the power unit 102, the prongs 200 are firmly extended so as not to be inadvertently retracted when the power adapter 100 is plugged into an outlet.

Retractable Output

As mentioned above, users often unplug AC adapters by pulling on a cord of the AC adapter adjacent to a plug. However, unplugging an AC adapter by the cord has the potential to damage the cord, possibly resulting in a fault, short, or even electrical shock to the user. Also, in some examples, this may result in the cord becoming detached from the AC adapter body.

The power adapter 100 described herein includes an electrical output 118, which is retractable during use to prevent users from grasping the cord adjacent to the plug to remove the power adapter from an outlet. In the non-use position (shown in FIG. 1) the electrical output 118 is extended flush with the housing of the power unit 102 to allow a user to plug in a power cord, such as a USB cable, to provide power from the power adapter 100 to an electronic device. When the power adapter 100 is rotated for use (as shown in FIG. 2), the electrical output 118 is retracted within the housing of the power unit 102 to prevent a user from grasping the power cord where it plugs into the electrical output 118. The retracted nature of the electrical outlet is designed to deter users from grasping the power cord, by making it more difficult to grasp the cord near where it plugs into the electrical output 118.

Additionally, because the electrical output 118 is retracted within the housing during use, a plug of the power cord is substantially housed within and protected by the housing. If a user bumps the power adapter 100 while it is plugged into an outlet (e.g., while vacuuming), the contact will likely be with the housing of the power adapter 100 or the flexible body of the power cord. This minimizes the likelihood of damage to the less flexible plug of the power cord.

Example Operation

Figure 3:
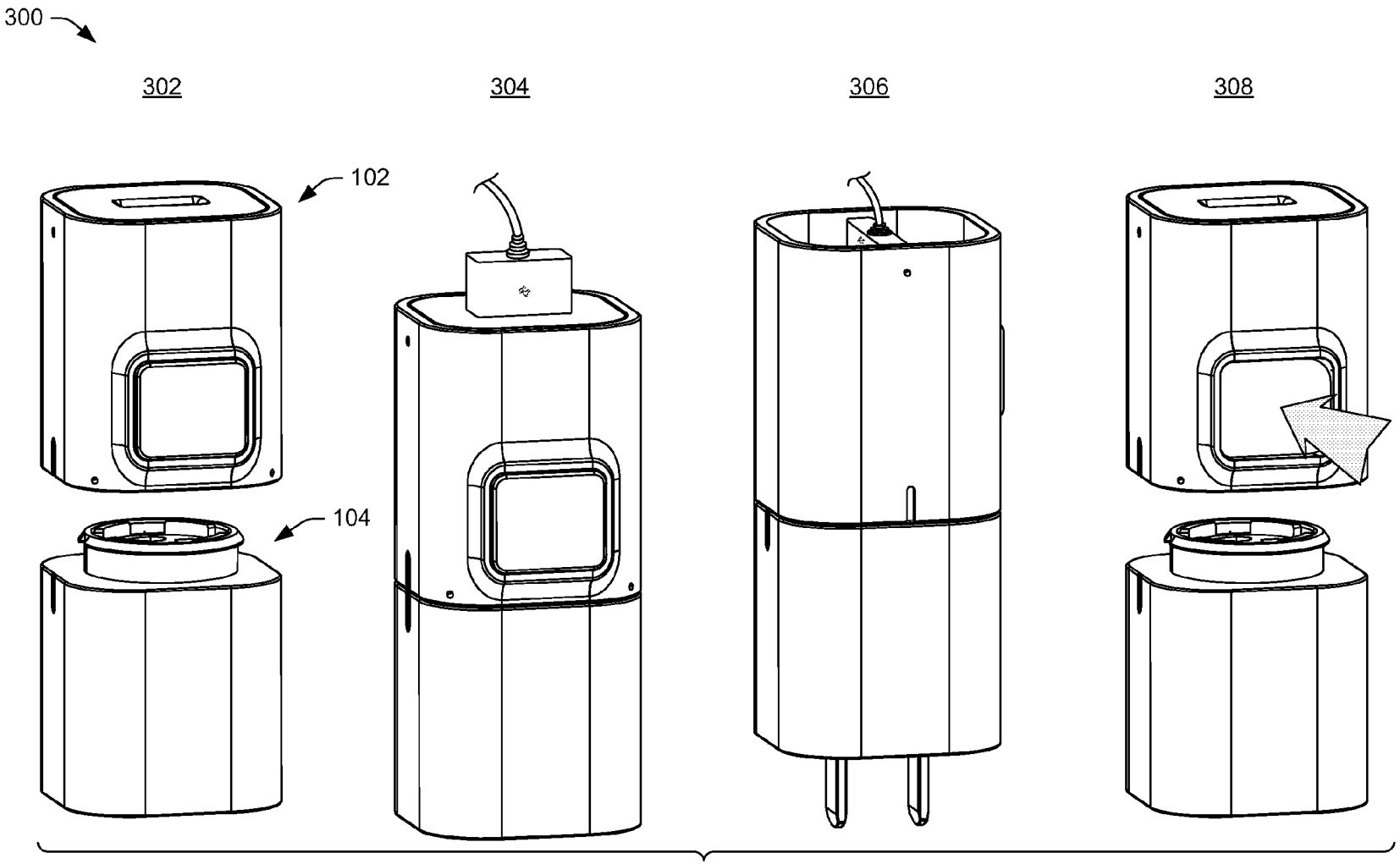
FIG. 3 is a schematic diagram showing the power adapter of FIG. 1 in a progression of positions.

FIG. 3 is a progression 300 illustrating operation of the example power adapter 100 of FIGS. 1 and 2. The progression 300 is described with reference to components of the adapter 100.

At 300, a plug unit 104 is coupled to the power unit by pressing the two parts substantially axially together. As discussed above, the plug unit 104 may comprise any of a variety of different plug configurations. As the parts are pressed together, the spring latch 110 of the power unit 102 slides past and latches behind the collar 108 of the plug unit 104.

At 302, the power adapter 100 is shown in a disassembled condition, similar to that of FIG. 1. In this configuration, the plug unit 104 is detached from the power unit 102.

At 304, the power adapter 100 is shown after the plug unit 104 has been coupled to the power unit 102 by pressing the two parts together. In this position, the collar 108 of the plug unit 104 is engaged and retained by the spring latch 110 of the power unit 102 to securely couple the plug unit 104 to the power unit 102. Also, a USB plug or other power cord has been plugged into the electrical output 118 to transmit power from the power adapter 100 to an electronic device.

At 306, the plug unit 104 has been rotated relative to the power unit 102 by about 90 degrees. The rotation of the plug unit 104 relative to the power unit 102 caused the prongs 200 to be extended from the housing of the plug unit 104 and the electrical output 118 to be retracted into the housing of the power unit 102. The position shown at 306 defines the use position for the power adapter 100. In this position, the prongs 200 are extended and can be plugged into a wall socket to provide power to the electronic device via the power cord. Also, the electrical output 118 is retracted to deter users from grasping the power cord to unplug the power adapter 100. When the user is finished using the electronic device, the power adapter can be unplugged by grasping the housing of the power adapter 100 and removing it from the wall socket.

The user may then proceed to retract the prongs 200 and extend the electrical output by rotating the power unit 104 back to the position shown at 304.

At 308, the user may remove the plug unit 104 from the power unit 102 (for storage or to exchange one plug unit for another) by pressing the release button 112. Depressing the release button 112 expands the spring latch 110 disengaging it from the collar 108 of the plug unit 104 and allowing the two parts to be separated (or ejecting the plug unit 104 from the power unit 102).

Example Construction

Figure 4:
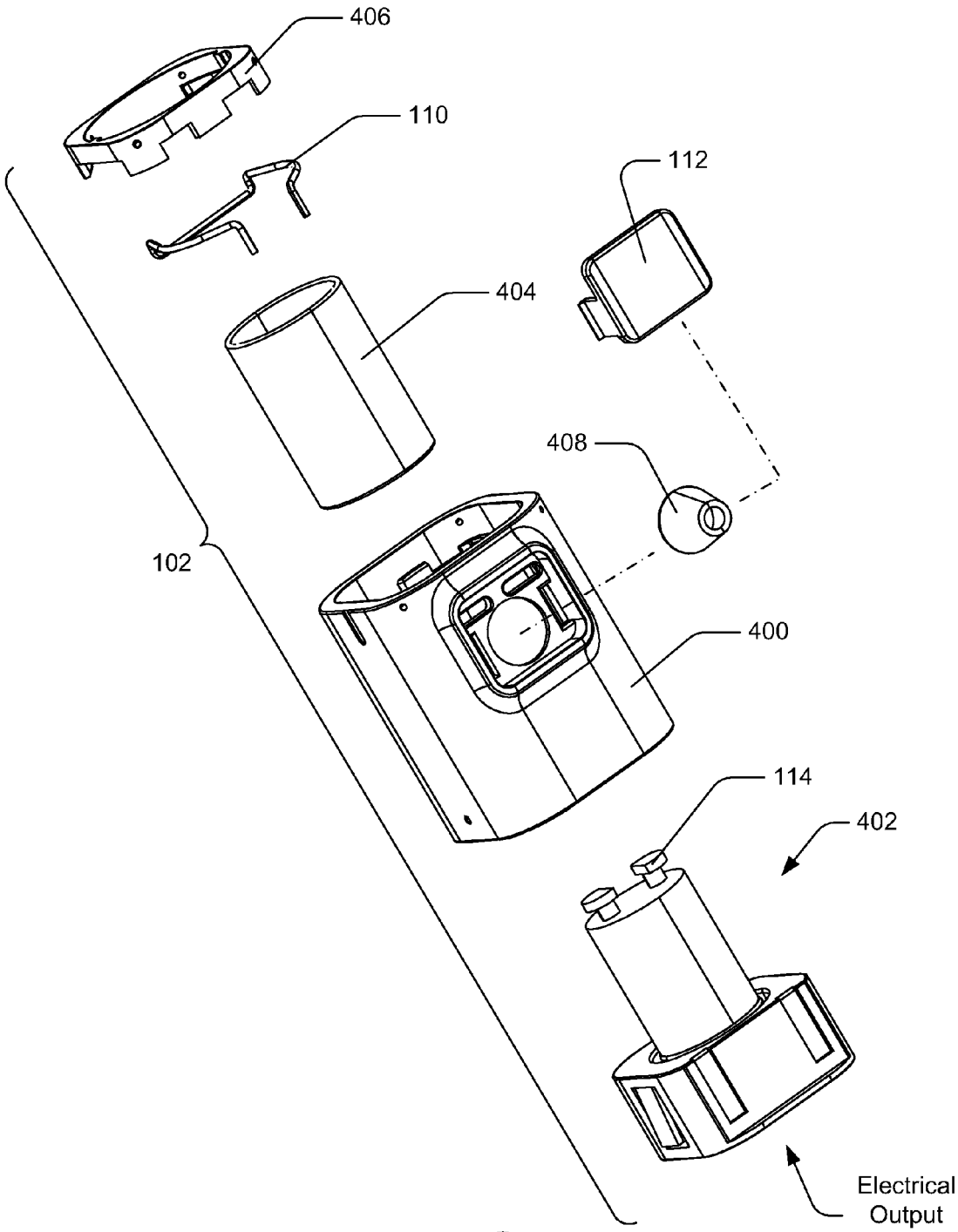
FIG. 4 is an exploded view showing details of a power unit of the power adapter of FIG. 1

FIG. 4 is an exploded view showing additional details of the construction of the power unit 102 of the power adapter 100 of FIG. 1. As shown in FIG. 4, the power unit 102 comprises an outer housing 400 that holds a power converter 402 configured to convert AC power from a wall socket into power usable by the electronic device (typically, but not necessarily, low voltage DC power). A power unit spring 404 is disposed between the power converter 402 and the housing 400 to bias the power converter 402 toward an exterior of the housing 400. That is, the power unit spring 404 biases the power converter 402 such that the electrical output 118 is flush with an end of the housing 400 generally as shown in FIG. 1.

The electrical terminals 114 are disposed at one end of the power converter 402 for engagement with terminals 116 of the plug units 104 to receive power from the plug unit 104. In some implementations, the electrical terminals 114 may be spring biased relative to the rest of the power converter 402 to provide a secure connection with the electrical terminals 116 on the plug unit 104. The electrical output 118 is not visible in this view, but is disposed on the power converter 402 on the side opposite the electrical terminals 114. The power converter 402 is retained in the housing 400 by a snap fit, but in other implementations may be retained by an interference fit, press fit, fasteners, adhesive, or any other suitable connecting means.

A spring latch retainer 406 is disposed in the plug-unit-engaging end of the housing 400 to hold the spring latch 110 in place in the housing 400. The release button 112 is disposed in a side of the housing 400 and is biased outward by a conical spring 408. When the release button 112 is depressed, tabs (not shown) on the back of the release button 112 engage ends of the spring latch 110 and expand the spring latch 110 in the direction of the arrows in detail view A in FIG. 1 in order to release the collar 108 of the plug unit 104.

Figure 5:
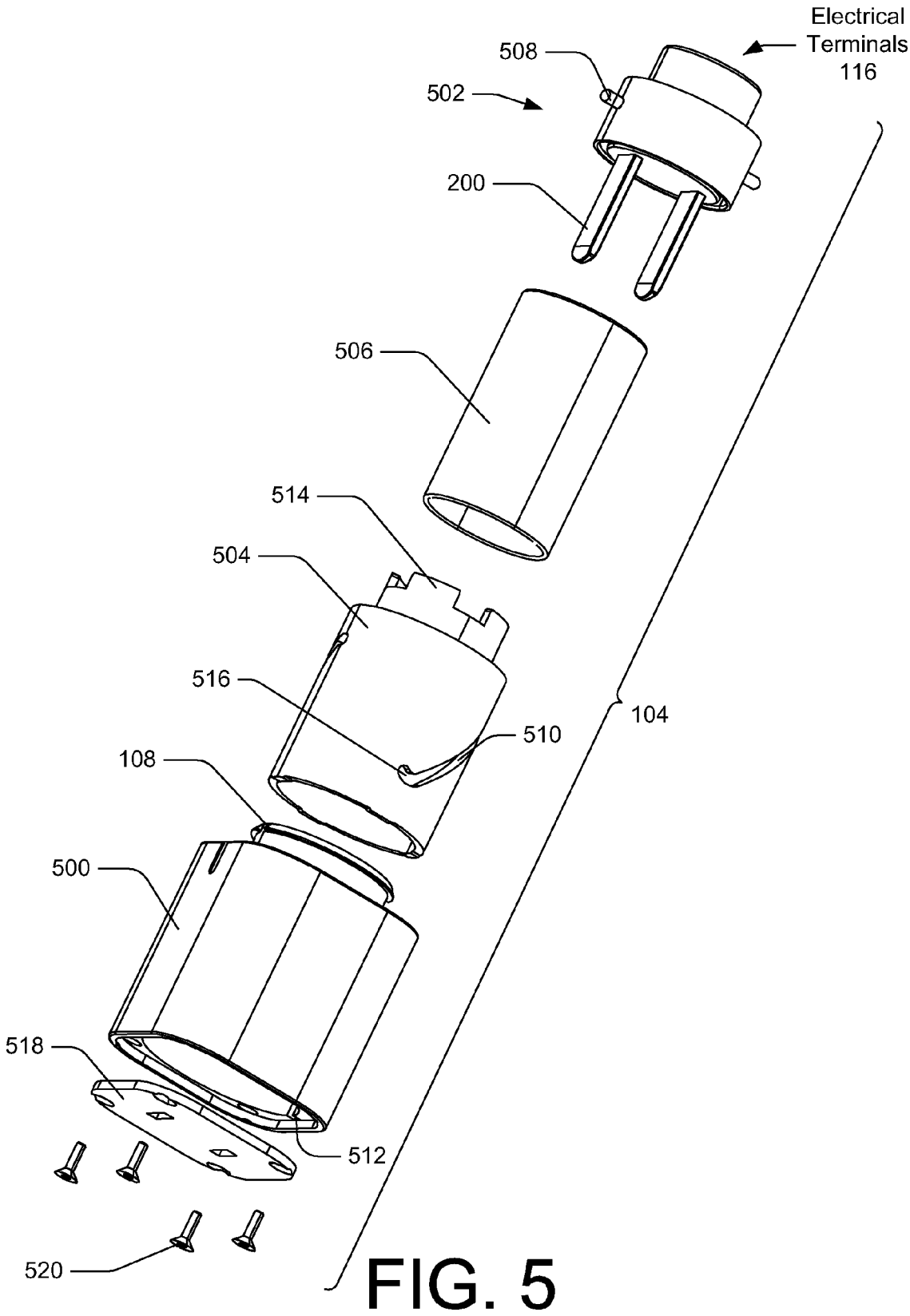
FIG. 5 is an exploded view showing details of a plug unit of the power adapter of FIG. 1

FIG. 5 is an exploded view showing additional details of the construction of plug units 104 of the power adapter 100 of FIG. 1. As shown in FIG. 5, the plug units 104 include a housing 500 that holds a slidable prong assembly 502, an actuation sleeve 504, and plug unit spring 506. The slidable prong assembly 502 is disposed within the actuation sleeve 504, and dowel pins 508 of the prong assembly 502 ride in helical grooves 510 of the actuation sleeve 504. The dowel pins 508 of the prong assembly 502 are longer than the thickness of the actuation sleeve 504 and, therefore, extend through the grooves 510 in the actuation sleeve 504 and into vertical guide grooves 512 in the housing 500. Thus, the dowel pins 508 are constrained by both the helical grooves 510 of the actuation sleeve 504 and the vertical guide grooves 512 of the housing 500. The vertical guide grooves 512 as their name suggests guide the prong assembly vertically and prevent rotation of the prong assembly relative to the housing.

When the plug unit 104 is coupled to the power unit 102, castellated protrusions 514 on the actuation sleeve 504 engage complimentary features of the power unit housing 400 to fix the actuation sleeve against rotation relative to the power unit 102. Thus, when the plug unit 104 is rotated relative to the power unit 102 (i.e., toward use position 304), the actuation sleeve 504 of the plug unit does not rotate with the other components of the plug unit 104. Consequently, as the plug unit 104 is rotated relative to the power unit 102, the prong assembly 502 is projected outwardly from the housing 500 as the dowel pins 508 are driven vertically in the vertical guide grooves 512 by the helical grooves 510 of the actuation sleeve 504. That is, as the plug unit 104 is rotated relative to the power unit 102, the prong assembly 502 is allowed to both rotate and translate vertically relative to the actuation sleeve 504, but is constrained by the vertical guide grooves 512 to move only vertically relative to the plug unit housing 500.

The ends of the helical grooves 510 include a locking notch 516. When the dowel pins 508 reach the ends of the helical grooves 510, they seat in these locking notches 516 (i.e., when the prong assembly is fully extended as shown in position 304). The locking notches 516 prevent the dowel pins 508 from sliding back down the helical grooves 510 due to compressive forces caused by, for example, a user pressing on the prongs 200 into a snug wall socket. Thus, the locking notches 516 prevent the prongs 200 from retracting unintentionally. To retract the prong assembly 502 requires a user to rotate the plug unit 104 relative to the power unit 102 to disengage the dowel pins 508 from the locking notches 516. Such rotational motion is unlikely to occur during plugging or unplugging the power adapter 100, thereby minimizing the likelihood that the prongs 200 will be retracted unintentionally.

An endplate 518 is secured to the end of the housing 500 by a plurality of fasteners 520 or other attachment means. The endplate 518 includes apertures configured to accommodate the prongs of the particular plug type when the prongs are extended, as in FIG. 2. In this example, the apertures are configured to accommodate a Type A two-prong plug.

While the exploded views of FIGS. 4 and 5 depict one illustrative configuration, other configurations and designs may alternatively be used to realize the features described herein. For example, other mechanisms may be used to drive the retractable prongs and/or the retractable electrical output. Moreover, other release mechanisms may be used to decouple plug units from the power unit.

CONCLUSION

Although the subject matter has been described in language specific to structural features and/or methodological acts, it is to be understood that the subject matter defined in the appended claims is not necessarily limited to the specific features or acts described. Rather, the specific features and acts are disclosed as illustrative forms of implementing the claims.

What is claimed is:

1. An electrical power adapter comprising:

a power unit having:

an electrical input terminal to receive an alternating current (AC) electrical power;

an AC-to-direct current (DC) converter housed in the power unit, wherein the electrical input terminal is disposed at an end of the AC-to-DC converter; and an electrical output to provide DC electrical power to a power cord plugged into the electrical output;

a plug unit having:

an electrical output terminal in contact with the electrical input terminal of the power unit to provide the AC electrical power to the power unit;

a collar coupled to a spring loaded latch disposed in the power unit;

a plurality of prongs configured to plug into an electrical outlet to provide AC power to the electrical output terminal of the plug unit in contact with the electrical input terminal of the power unit; and wherein the plug unit is rotatable relative to the power unit between:

a storage position in which the prongs are retracted within a housing of the plug unit to protect the prongs while not in use, and the electrical output of the power unit is exposed flush with an end of a housing of the power unit to provide for plugging the power cord into the electrical output of the power unit; and a use position in which the prongs are extended from the housing of the plug unit and are ready to be plugged into the electrical outlet, and the electrical output of the power unit is retracted within the housing of the power unit to protect the power cord plugged into the electrical outlet.

2. The electrical power adapter of claim 1, further comprising a release button disposed on the power unit for decoupling the plug unit from the power unit.

3. The electrical power adapter of claim 1, wherein the electrical output comprises a universal serial bus (USB) receptacle.

4. The electrical power adapter of claim 1, wherein the plug unit comprises a type A, B, C, G, or I plug standard.

* * * * *